US012144422B2

(12) United States Patent
Choi

(10) Patent No.: US 12,144,422 B2
(45) Date of Patent: Nov. 19, 2024

(54) PANEL ASSEMBLY AND TABLE FOR HANGING OBJECTS

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 234 days.

(21) Appl. No.: 17/857,909

(22) Filed: Jul. 5, 2022

(65) Prior Publication Data

US 2023/0225500 A1 Jul. 20, 2023

(30) Foreign Application Priority Data

Jan. 14, 2022 (CN) ..... 202220102192.7
Jan. 14, 2022 (CN) ..... 202230024677.4
Jan. 14, 2022 (CN) ..... 202230024879.9

(51) Int. Cl.
*A47B 9/16* (2006.01)
*A47B 3/02* (2006.01)
*A47B 3/08* (2006.01)
*A47B 13/08* (2006.01)

(52) U.S. Cl.
CPC ..... *A47B 9/16* (2013.01); *A47B 3/02* (2013.01); *A47B 3/08* (2013.01); *A47B 13/08* (2013.01); *A47B 2003/025* (2013.01); *A47B 2003/0821* (2013.01); *A47B 2200/005* (2013.01)

(58) Field of Classification Search
CPC .... A47B 9/16; A47B 3/02; A47B 3/08; A47B 13/08; A47B 2003/025; A47B 2003/0821; A47B 2003/0827; A47B 2200/005; A47B 95/043; A47B 3/10
USPC ..... 108/116, 29, 27
See application file for complete search history.

(56) References Cited

U.S. PATENT DOCUMENTS

D51,594 S 12/1917 Holman
1,693,802 A * 12/1928 Bailey ..... A47F 5/04 108/23
D116,560 S 9/1939 Hoffmann
2,240,395 A * 4/1941 James ..... A47B 13/081 108/130
2,879,119 A 3/1959 Bullock
5,711,572 A * 1/1998 Khan ..... A47B 3/14 297/173
5,809,901 A * 9/1998 Gutzmer ..... A47B 13/083 52/716.3
6,044,774 A * 4/2000 Gelbart ..... A47B 95/043 108/90

(Continued)

FOREIGN PATENT DOCUMENTS

KR 101180484 B1 * 9/2012

*Primary Examiner* — Janet M Wilkens
(74) *Attorney, Agent, or Firm* — MORGAN, LEWIS & BOCKIUS LLP

(57) ABSTRACT

A table includes a supporting frame and a panel assembly supported by the supporting frame. A panel assembly includes a panel, a plurality of connectors, and one or more elongated members connected to the panel by the plurality of connectors. The one or more elongated members include a first elongated member disposed adjacent to but spaced apart from a first portion of the outer periphery of the panel, creating a gap in between. The presence of the gap allows one to hang objects, such as water bottles, bags, umbrellas, directly or indirectly to the first elongated member.

20 Claims, 10 Drawing Sheets

(56) References Cited

U.S. PATENT DOCUMENTS

| | | | | |
|---|---|---|---|---|
| 6,659,546 | B2 * | 12/2003 | Schmeing | A47B 3/14 297/157.1 |
| D499,283 | S | 12/2004 | Winter | |
| 8,220,766 | B2 * | 7/2012 | Fuoss | A47B 13/083 211/183 |
| 8,307,769 | B1 * | 11/2012 | Wescott | A47B 3/0912 108/132 |
| D681,982 | S | 5/2013 | Clegg | |
| D682,586 | S | 5/2013 | Clegg | |
| 10,349,738 | B1 | 7/2019 | Choi | |
| 10,806,247 | B1 * | 10/2020 | Chen | A47B 3/0913 |
| D966,765 | S | 10/2022 | Anderson | |
| 2010/0231102 | A1 * | 9/2010 | Block | A47B 21/0314 108/115 |
| 2015/0201748 | A1 * | 7/2015 | Nivens | B43L 5/025 108/29 |
| 2016/0007745 | A1 * | 1/2016 | Parshad | A47B 83/001 108/69 |
| 2021/0059399 | A1 * | 3/2021 | Chen | F16M 11/38 |
| 2023/0225500 | A1 | 7/2023 | Choi | |

* cited by examiner

PANEL ASSEMBLY AND TABLE FOR HANGING OBJECTS

CROSS-REFERENCE TO RELATED APPLICATIONS

The present application claims priority to Chinese Application Numbers CN 202230024879.9 filed Jan. 14, 2022, CN 202230024677.4 filed Jan. 14, 2022, and CN 202220102192.7 filed Jan. 14, 2022, the disclosure of each application is incorporated herein for all purposes by reference in its entirety.

FIELD OF THE INVENTION

The present invention generally relates to panel assemblies and tables for hanging objects.

BACKGROUND

A table generally includes a tabletop and a supporting frame to support the tabletop. Objects, such as water bottles, bags or umbrellas, are often placed on the tabletop. However, in many cases, a tabletop is relatively small and cannot accommodate all the objects that need to be placed. As such, many objects have to be placed on the ground or stacked on the tabletop. This is neither sanitary nor safe.

Given the current state of the art, there remains a need for tables that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides panel assemblies and tables for hanging objects.

In various exemplary embodiments, the present disclosure provides a panel assembly including a panel, a plurality of connectors, and one or more elongated members connected to the panel by the plurality of connectors. The panel has an outer periphery. The plurality of connectors includes a first connector and a second connector. The one or more elongated members include a first elongated member. The first elongated member has a first end portion connected to the panel by the first connector and a second end portion connected to the panel by the second connector. The first elongated member is disposed adjacent to a first portion of the outer periphery of the panel and spaced apart from the first portion of the outer periphery of the panel, thereby creating a first gap between the first elongated member and the first portion of the outer periphery of the panel.

In some exemplary embodiments, the panel includes a first panel unit and a second panel unit.

In some exemplary embodiments, the one or more elongated members are disposed along at least a majority (e.g., greater than about 50%, about 60%, about 70%, about 80% or more) of the outer periphery of the panel.

In some exemplary embodiments, the one or more elongated members include a second elongated member disposed adjacent to a second portion of the outer periphery of the panel and spaced apart from the second portion of the outer periphery of the panel, thereby creating a second gap between the second elongated member and the second portion of the outer periphery of the panel.

In some exemplary embodiments, the panel includes a first corner between the first and second portions of the outer periphery. The first connector is disposed at or adjacent to the first corner, and includes a first connecting portion to connect the first end portion of the first elongated member to the first portion of the outer periphery of the panel and a second connecting portion to connect an end portion of the second elongated member to the second portion of the outer periphery of the panel.

In some exemplary embodiments, the first connector further includes a third connecting portion between the first and second connecting portions.

In some exemplary embodiments, a slot is formed in the third connecting portion of the first connector.

In some exemplary embodiments, an outer surface of the third connecting portion includes one or more creases, grooves, ribs, strips, rims or any combination thereof.

In some exemplary embodiments, the panel includes a second corner; and the second connector is substantially the same as the first connector and is disposed at or adjacent to the second corner.

In some exemplary embodiments, the first portion of the outer periphery of the panel is longer than the first elongated member; and the second connector is different than the first connector, and is substantially linear or straight.

In an exemplary embodiment, the second connector includes a bottle opener.

In various exemplary embodiments, the present disclosure provides a table including a supporting frame, and a panel assembly disclosed herein. The panel assembly is coupled with the supporting frame and supported by the supporting frame.

In some exemplary embodiments, the supporting frame includes a first support and a second support. The first support is movably coupled with the panel assembly at a first panel portion of the panel assembly, and the second support is movably coupled with the panel assembly at a second panel portion of the panel assembly. The first and second supports collectively form one or more pairs of scissor lifts to allow change a height of the supporting frame.

In some exemplary embodiments, the supporting frame includes a first support and a second support. The first support is coupled with the panel assembly at a first panel portion of the panel assembly, and a second support coupled with the panel assembly at a second panel portion of the panel assembly. Each of the first and second supports has a length that is adjustable to allow adjustment of a height of the supporting frame.

In an exemplary embodiment, each of the first and second supports includes a first adjustable leg, a second adjustable leg, and an adjustment mechanism. The first and second adjustable legs are spaced apart from each other and substantially parallel to each other. The adjustment mechanism is disposed between the first and second adjustable legs to selectively allow the first and second adjustable legs to adjust their lengths, thereby selectively allowing adjustment of the height of the supporting frame.

In an exemplary embodiment, the panel has four corners and the plurality of connectors has four connectors, each disposed at or adjacent to one of the four corners.

In another exemplary embodiment, the panel has four corners and the plurality of connectors has more than four connectors, of which at least one connector is disposed away from any one of the four corners.

The panel assembly and tables of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1A:
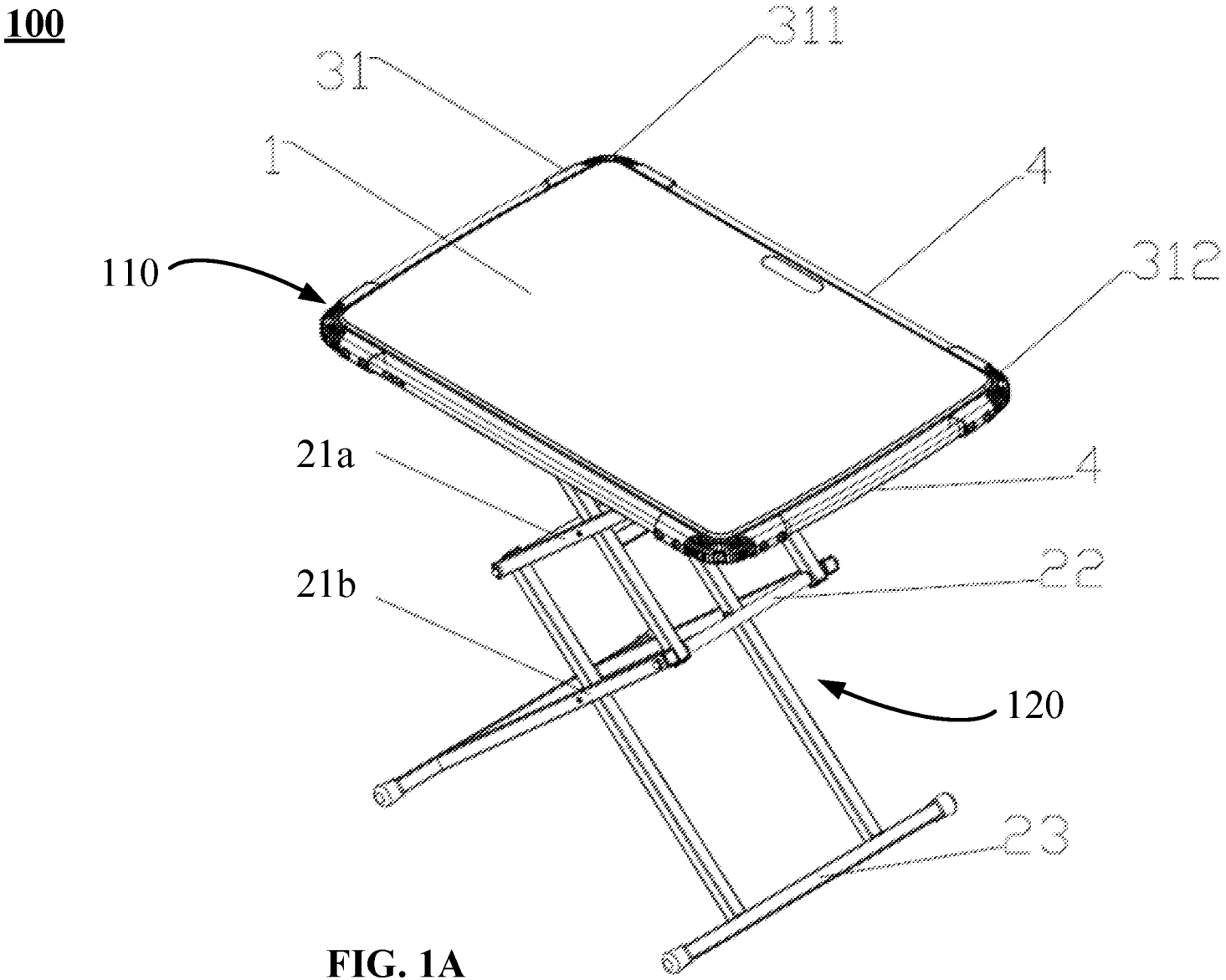
FIG. 1A is a top perspective view illustrating an exemplary table in accordance with some exemplary embodiments of the present disclosure.
Figure 1B:
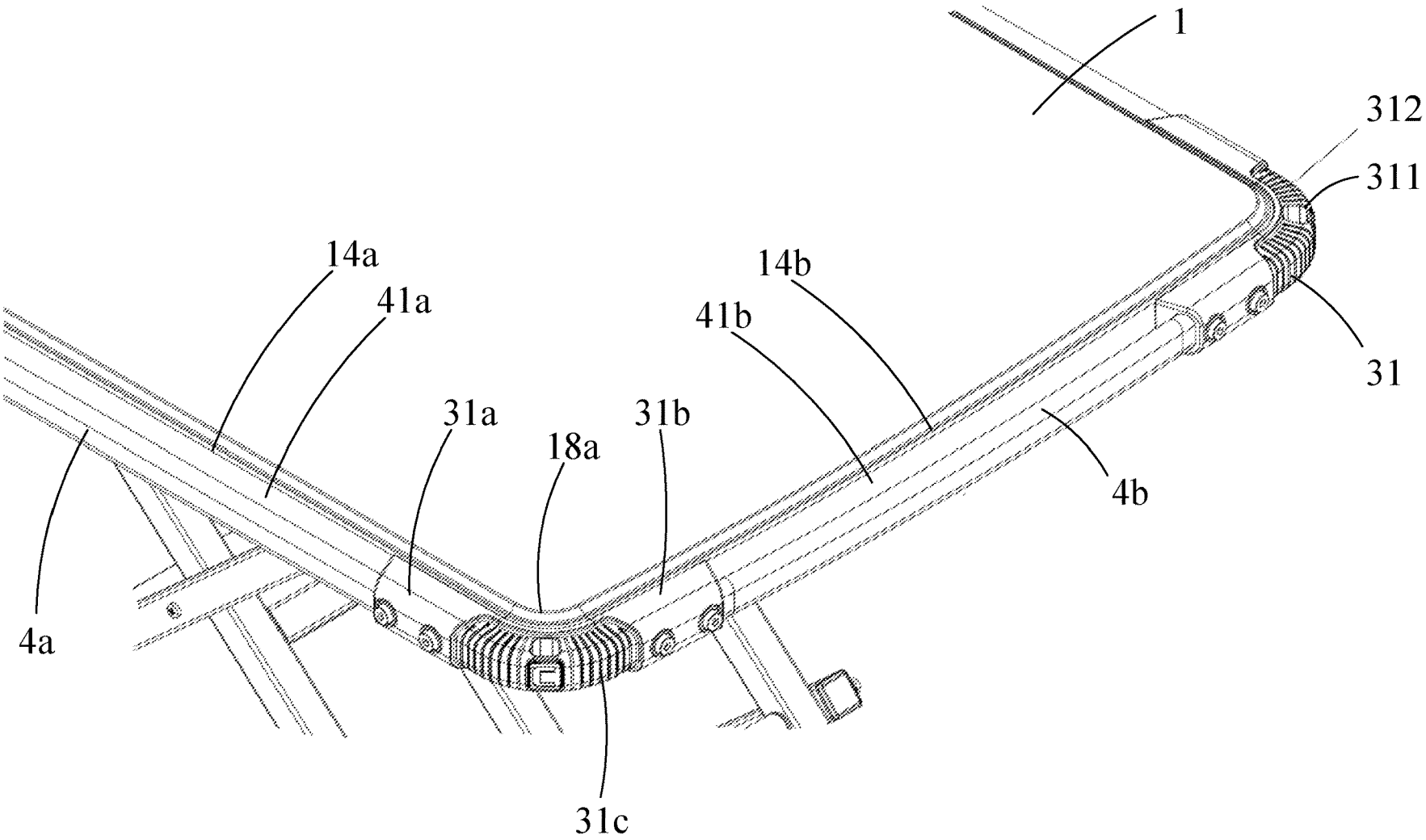
FIG. 1B is an enlarged view illustrating a portion of the exemplary table of FIG. 1A.
Figure 2:
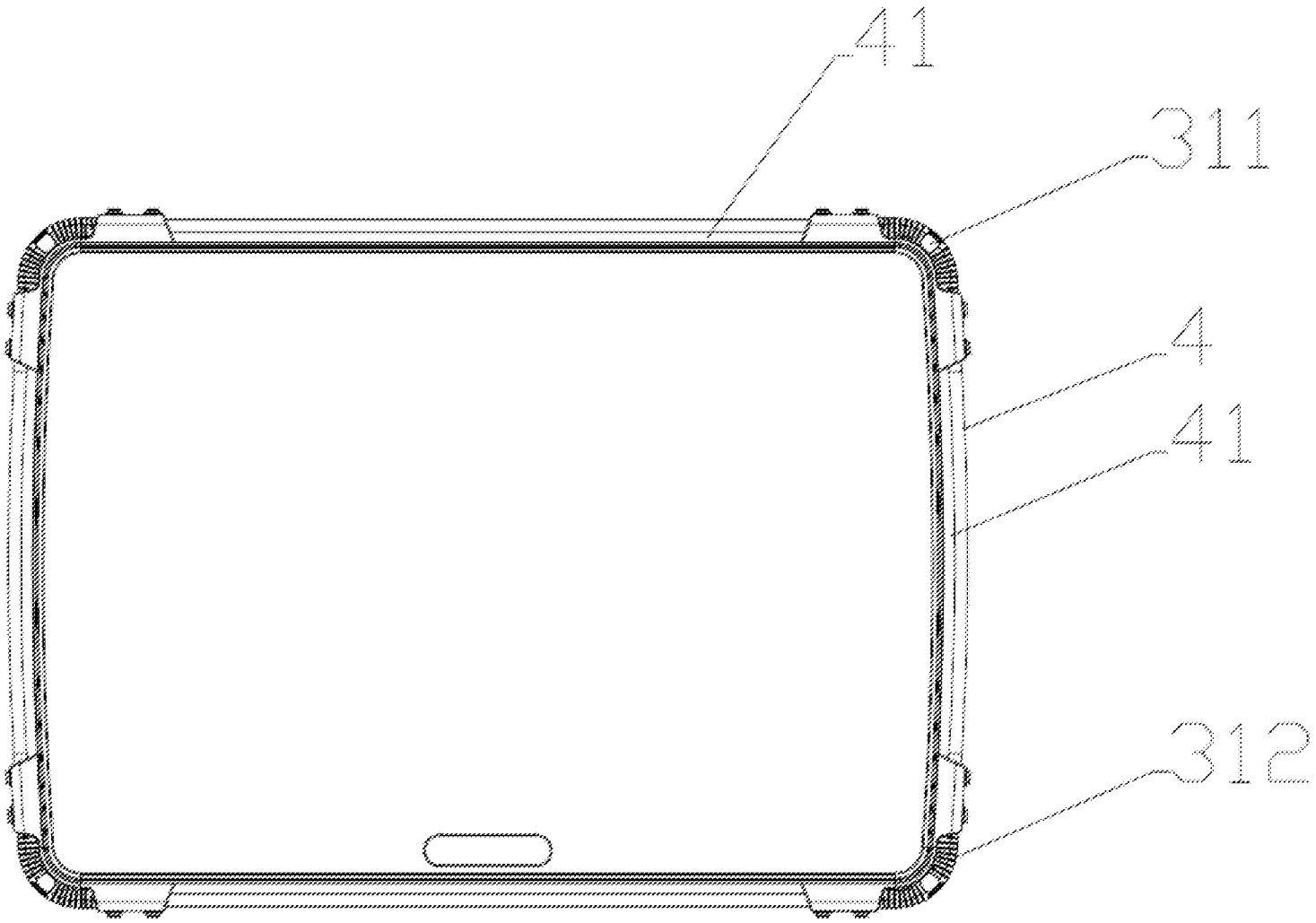
FIG. 2 is a top view illustrating the exemplary table of FIG. 1A.
Figure 3:
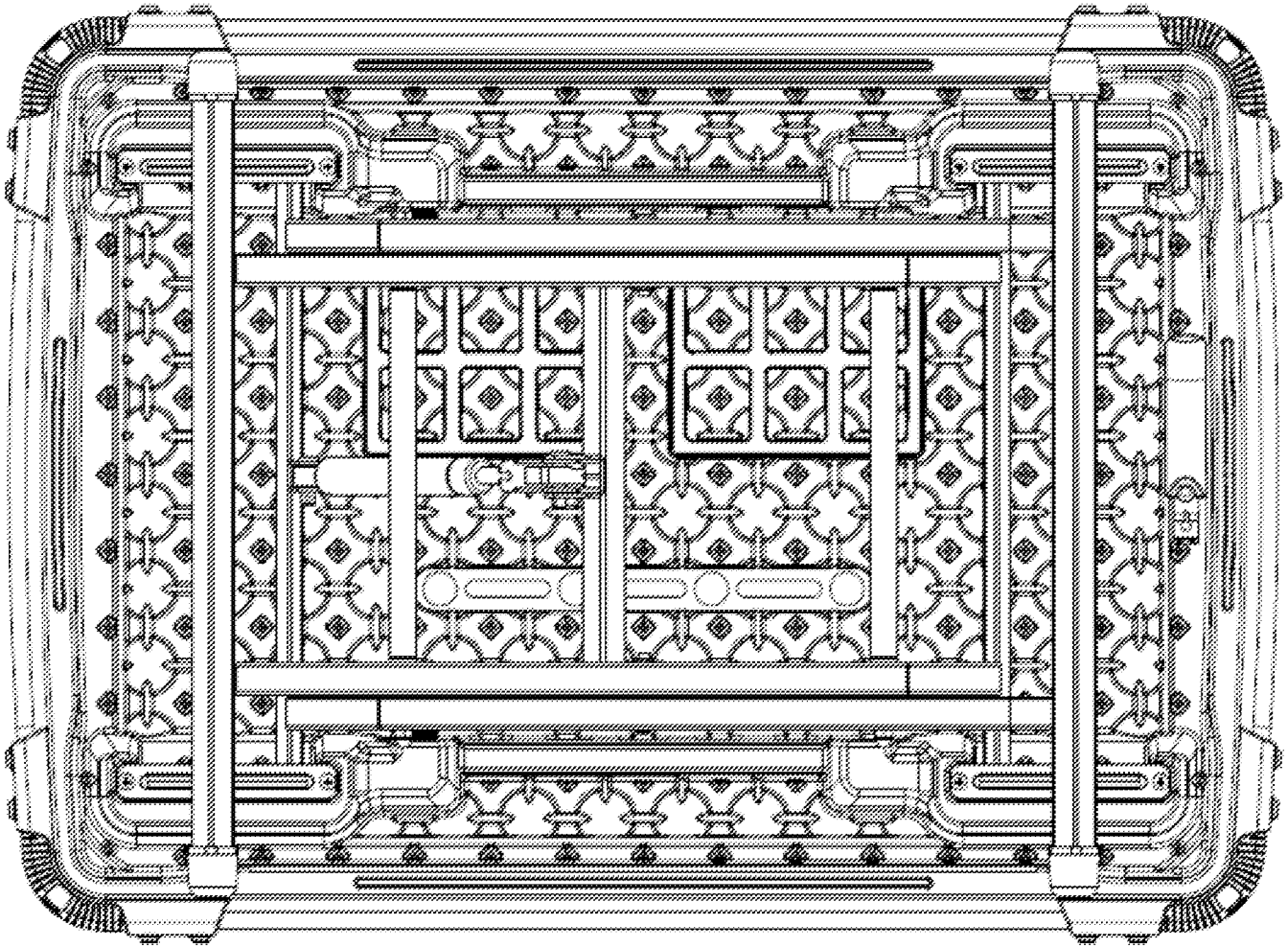
FIG. 3 is a bottom view illustrating the exemplary table of FIG. 1A.
Figure 4A:
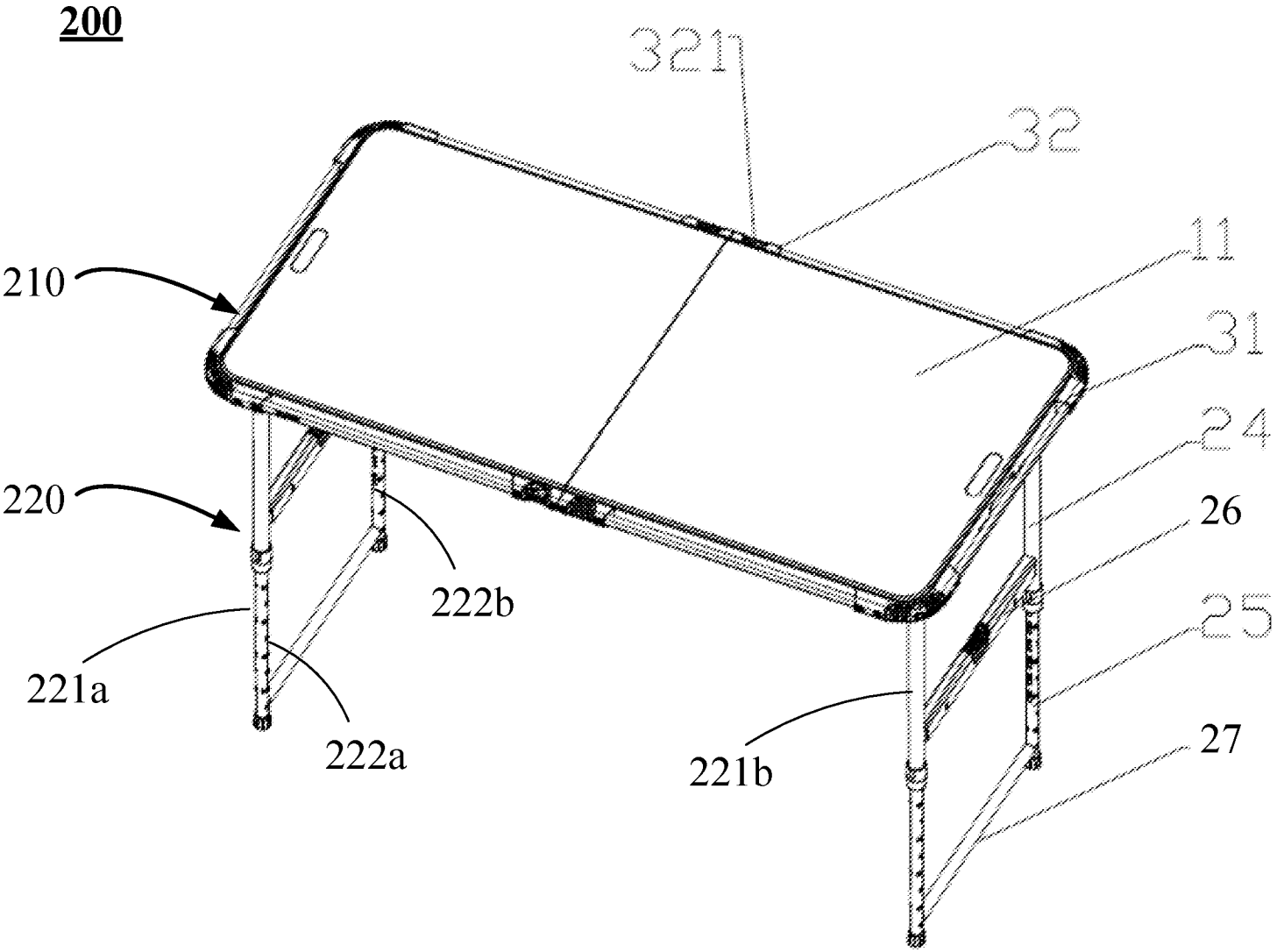
FIG. 4A is a top perspective view illustrating another exemplary table in accordance with some exemplary embodiments of the present disclosure.
Figure 4B:
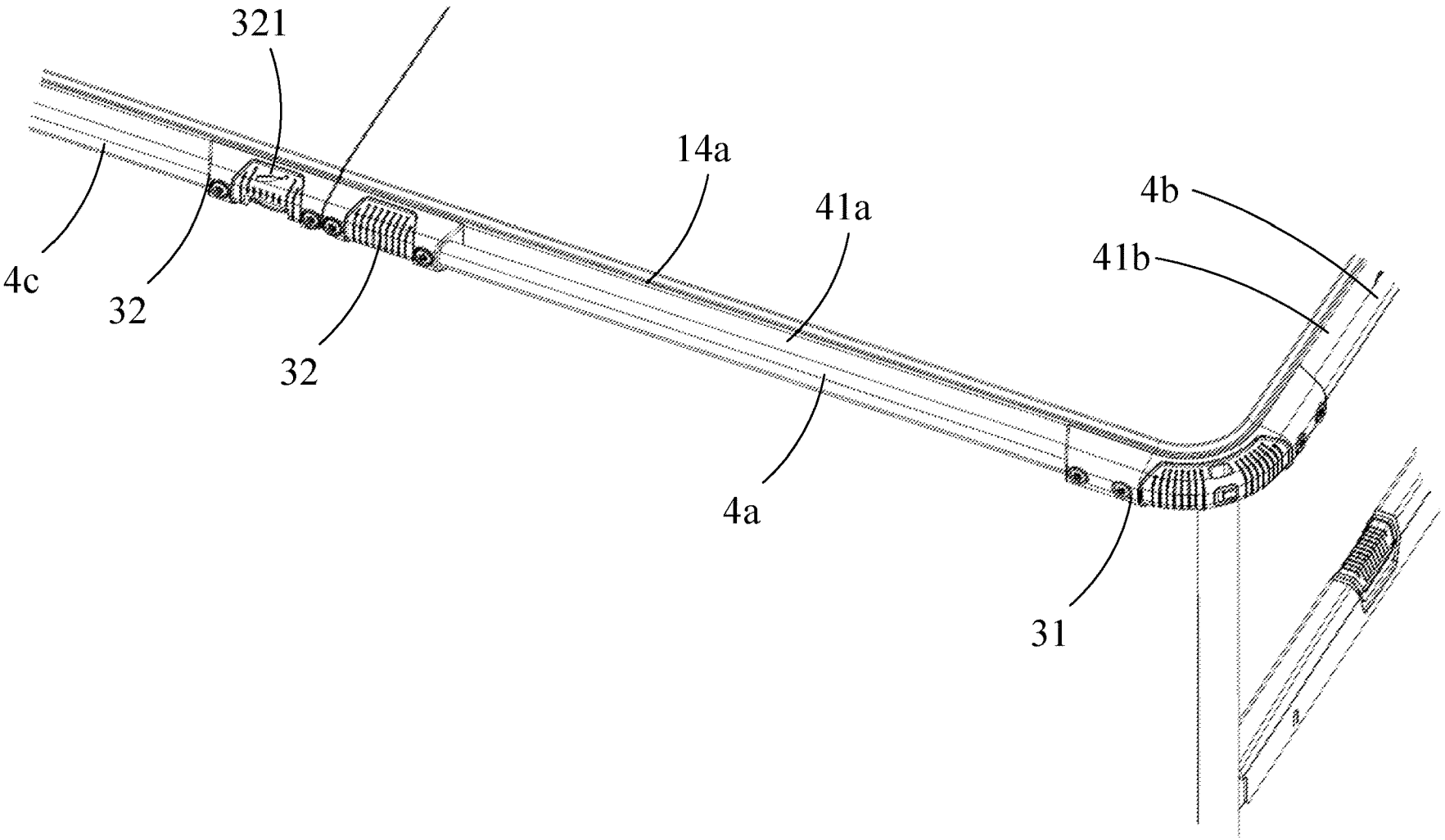
FIG. 4B is an enlarged view illustrating a portion of the exemplary table of FIG. 4A.
Figure 5:
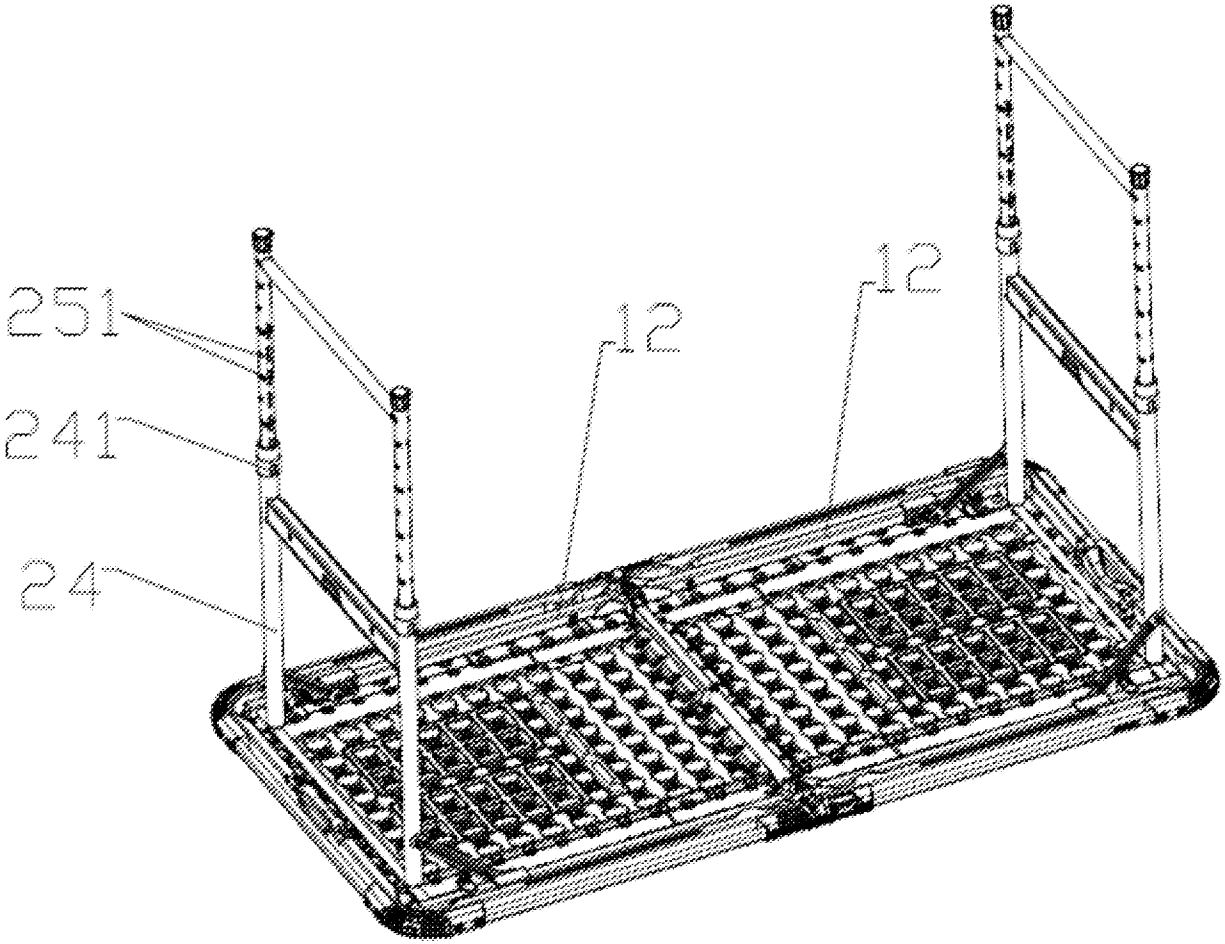
FIG. 5 is a bottom perspective view illustrating the exemplary table of FIG. 4A.
Figure 6:
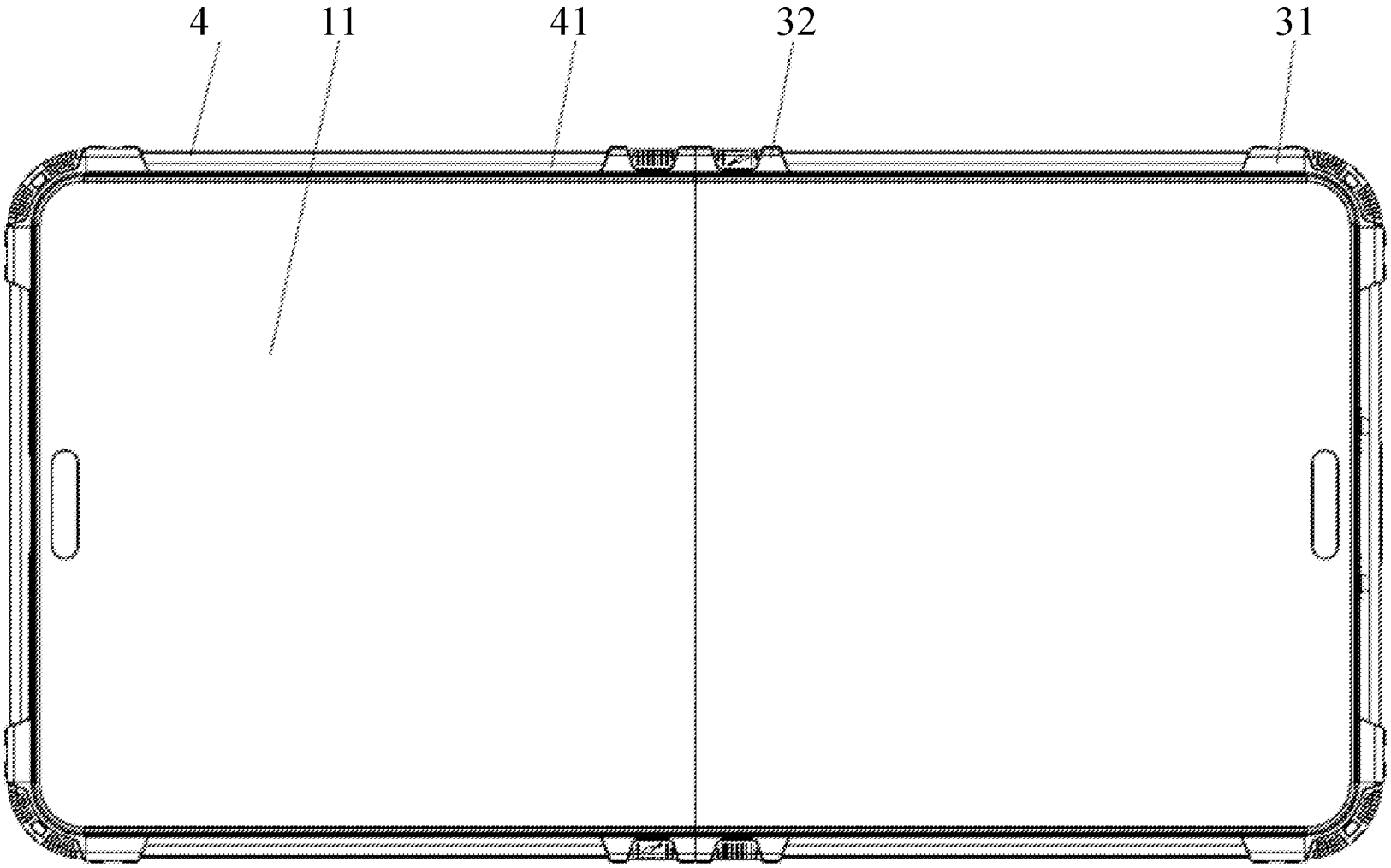
FIG. 6 is a top view illustrating the exemplary table of FIG. 4A.
Figure 7:
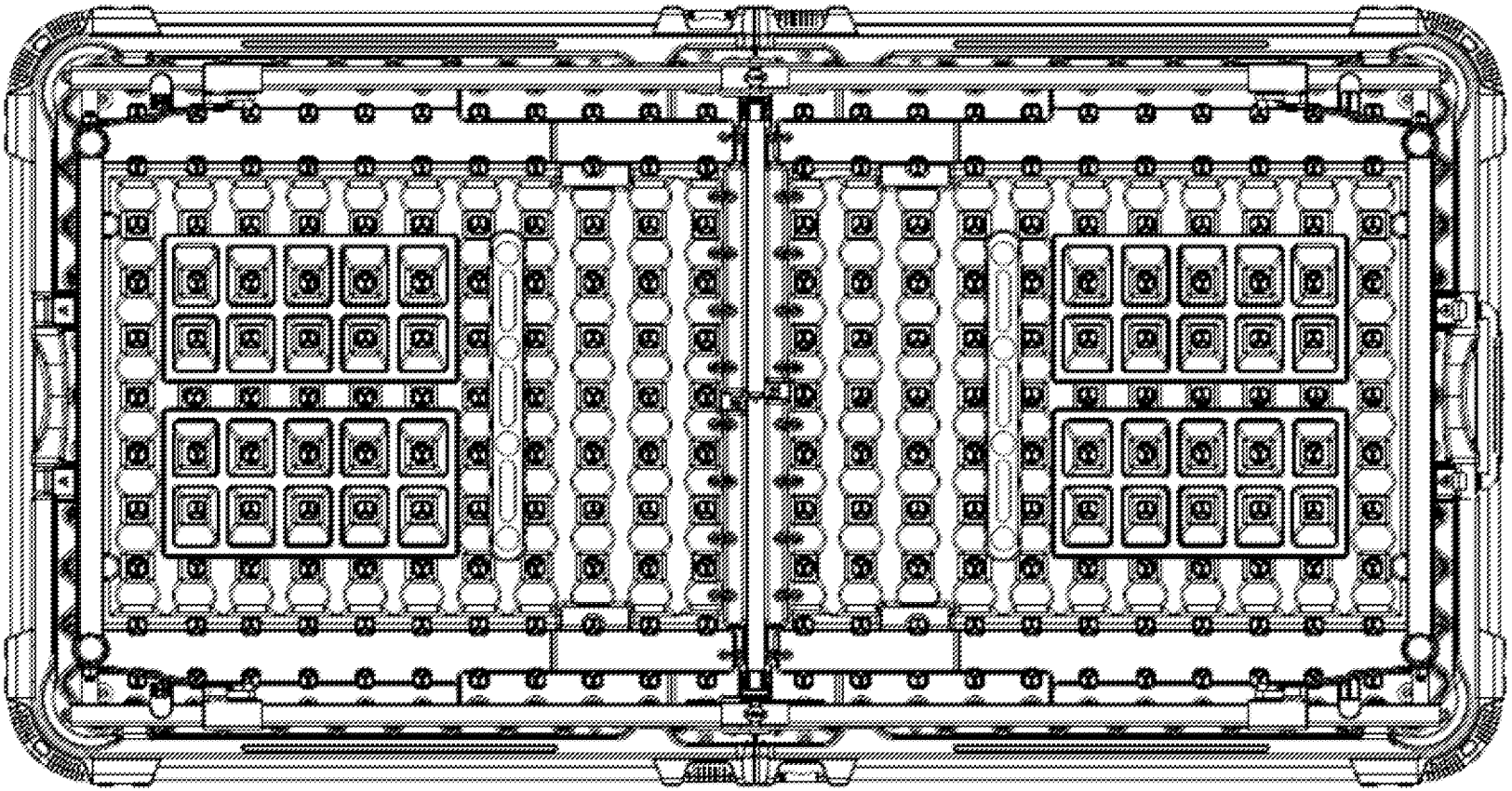
FIG. 7 is a bottom view illustrating the exemplary table of FIG. 4A.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementations of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present disclosure are described in the context of tables. A table of the present disclosure generally includes a supporting frame and a panel assembly coupled with and supported by the supporting frame. It can be a coffee table, a dining table, a picnic table or the like. A panel assembly includes a panel and one or more elongated members connected to the panel. The one or more elongated members are disposed adjacent to the outer periphery (a portion or the entire periphery) of the panel and spaced apart from the outer periphery of the panel. This creates one or more gaps between the one or more elongated members and the outer periphery of the panel. The presence of the one or more gaps allows users to hang objects directly or indirectly on any one of the one or more elongated members when desired or needed. For instance, when there are too many objects to put on a table, one can hang some objects (e.g., water bottles, bags, umbrellas, or the like) directly to an elongated member or indirectly (e.g., via a hook or the like) to an elongated member. In addition, with the one or more elongated members, the panel assembly is stronger and the table is more robust.

The panel can have any suitable sizes and shapes (regular or irregular), including but not limited to rectangular shapes, square shapes, circular shapes, half circular shapes, oval shapes, oblong shapes or the like. The panel can also include one, two, three, four, or more than four panel units. For instance, in an exemplary embodiment, the panel includes a single panel unit. In another exemplary embodiment, the panel includes two panel units, which can be fixed or movable (e.g., foldable) with respect to each other.

The panel can be made of any suitable materials, including but not limited to plastics, woods or metals. In an exemplary embodiment, the panel or each unit of the panel is a unitary piece formed by blow molding plastics such as high-density polyethylene (HDPE), low density polyethylene (LDPE), polypropylene (PP), polyvinyl chloride (PVC), polyethylene terephthalate (PET), thermoplastic elastomers (TPE), or the like. The blow-molded panel or panel unit generally includes a first panel wall, a second panel wall and a generally hollow interior formed between the first and second panel walls. In addition, the panel can have other features, such as depressions, ridges, or the like, monolithically formed with the first and/or second panel walls.

The one or more elongated members can include one, two, three, four, five, six or more than six elongated members, and can be disposed along a portion or the entirety of the outer periphery of the panel. An elongated member can have any suitable shapes and lengths. For instance, an elongated member can have a regular or irregular cross section, including but not limited to square, rectangular, circular, oval, oblong, pentagonal or hexagonal shapes. Also, an elongated member can be straight, curved, or partially straight and partially curved. For instance, in an exemplary embodiment, a panel assembly includes a single substantially straight elongated member disposed along a portion of the outer periphery of the panel. In another exemplary embodiment, a panel assembly includes a single curved, bended, or U-shaped elongated member disposed along a majority or the entirety of the outer periphery of the panel. In a further exemplary embodiment, a panel assembly includes two or more elongated members, each of which is disposed at one side of the panel. As used herein, a majority of the outer periphery of the panel refers to more than about 50%, more than about 60%, more than about 70%, more than about 80%, more than about 90%, or greater of the outer periphery of the panel. Further, an elongated member can be made of any suitable materials, including but not limited to woods, plastics, metals or the like. For instance, in some exemplary embodiments, an elongated member is made of a hollow metal tube. In addition, two elongation members can have the same, similar or different configurations in terms of size, shape, length, material or the like.

The plurality of connectors can have the same, similar or different configurations. For instance, in an exemplary embodiment, all of the connectors are substantially the same. In another exemplary embodiment, at least one connector is different than another connector.

Referring now to FIGS. 1A-3, there is depicted exemplary table 100 in accordance with some exemplary embodiments of the present disclosure. Table 100 generally includes a panel assembly, such as panel assembly 110, and a supporting frame, such as supporting frame 120, to support the panel assembly. Panel assembly 110 includes a panel, such as panel 1, and one or more elongated members, generally designated 4 and more specifically designated 4*a*, 4*b*, etc. The one or more elongated members are connected to panel 1 by a plurality of connectors, such as connector 31.

While panel 1 is shown to be a single panel unit of a rectangular shape, it should be noted that this is by way of example and is non-limiting. Panel 1 can include any suitable number of panel units and can have any suitable sizes and shapes. Similarly, while four substantially straight elongated members are shown with one on each side of panel 1, it should be noted that this is by way of example and is non-limiting. Panel assembly 110 can have one, two, three, four, or more than four elongated members. While four substantially the same connectors are shown with one on each corner of panel 1, it should be noted that this is by way of example and is non-limiting. Panel assembly 110 can have two, three, four, or more than four connectors, either the same or different from each other.

An elongated member is generally disposed adjacent to but spaced apart from at least a portion of the outer periphery of the panel, thereby creating a gap in between. A gap is generally designated 41 and more specifically designated 41*a*, 41*b*, etc. For instance, referring in particular to FIG. 1B, a first elongated member (e.g., elongated member 4*a*) is disposed adjacent to a first portion of the outer periphery of the panel (e.g., outer edge 14*a*) and connected to the panel by connectors 31. The first elongated member is spaced apart from the first portion of the outer periphery of the panel, thereby creating a first gap (e.g., gap 41*a*) between the first elongated member and the first portion of the outer periphery of the panel. Similarly, a second elongated member (e.g., elongated member 4*b*) is disposed adjacent to a second portion of the outer periphery of the panel (e.g., outer edge 14*b*) and connected to the panel by connectors 31. The second elongated member is spaced apart from the second portion of the outer periphery of the panel, thereby creating a second gap (e.g., gap 41*b*) between the second elongated member and the second portion of the outer periphery of the panel. The second elongated member can be the same as, similar to, or different than the first elongated member in terms of size, shape, length or material. The second gap (e.g., the spacing between the second elongated member and the second portion of the outer periphery of the panel) can be the same as, similar to, or different than different than the first gap.

In some exemplary embodiments, the panel includes a corner between the first and second portions of the outer periphery, e.g., corner 18*a* between outer edge 14*a* and outer edge 14*b*. In such embodiments, connector 31 preferably has a first connecting portion, such as connecting portion 31*a*, and a second connecting portion, such as connecting portion 31*b*. The first connecting portion is configured to connect an end of the first elongated member to the panel, e.g., outer edge 14*a* of the outer periphery. The second connecting portion is configured to connect an end of the second elongated member to the panel, e.g., outer edge 14*b* of the outer periphery of the panel.

In some exemplary embodiments, connector 31 includes a third connecting portion, such as connecting portion 31*c*, between the first and second connecting portions. Preferably an outer surface of the third connecting portion is rounded or arched to reduce the sharpness of corners and prevent collision incidents. In some exemplary embodiments, a slot, such as slot 311, is formed at connector 31. The slot can be a through-groove, a through-hole, or the like. In an exemplary embodiment, the slot is formed at the third connecting portion of connector 31. Using a cord, lanyard, clasp or the like, small objects such as cups, bottles, smart phones or the like can be hooked or fastened to the slot. In some exemplary embodiments, an outer surface of the third connecting portion is formed with one or more enhancement members 312 to enhance the strength, flexibility, and/or aesthetic appearance of the connector. Non-limiting examples of enhancement members include creases, wrinkles, grooves, ribs, strips, rims or any combination thereof.

In some exemplary embodiments, supporting frame 120 includes a first support, such as first support 21*a*, and a second support, such as second support 21*b*. The first support is movably coupled (directly or indirectly) with the panel assembly at a first panel portion of the panel assembly. The second support is movably coupled (directly or indirectly) with the panel assembly at a second panel portion of the panel assembly. In some exemplary embodiments, the first and second supports collectively form one or more pairs of scissor lifts to allow users to change a height of the supporting frame and thus to change a height of the table to meet different uses or preferences. As a non-limiting example, two pairs of scissor lifts are shown.

In some exemplary embodiments, each of the first and second support includes two supporting assemblies and a base, such as base 23. The two supporting assemblies are disposed substantially parallel to each other, with the base connected to the lower portions of the two supporting assemblies. In some exemplary embodiments, additionally or optionally, each of the first and second support includes one or more cross members, such as cross member 22, connected to the middle portions of the two supporting assemblies. In some exemplary embodiments, supporting frame 120 is substantially the same as or similar to those disclosed in U.S. patent application Ser. No. 15/931,925 (now U.S. Pat. No. 10,939,751 B1), the disclosure of the application is incorporated herein for all purposes by reference in its entirety.

Referring now to FIGS. 4A-7, there is depicted exemplary table 200 in accordance with some exemplary embodiments of the present disclosure. Table 200 generally includes a panel assembly, such as panel assembly 210, and a supporting frame, such as supporting frame 220, to support the panel assembly. As a non-limiting example, panel assembly 210 is shown to include a panel made of two panel units 11, and a plurality of elongated members (e.g., 4*a*, 4*b*, 4*c*) connected to the panel by a plurality of connectors 31 and connectors 32.

While connector 31 is generally disposed at a corner of the panel, connector 32 is disposed away from a corner of the panel and configured to connect an elongated member to the panel at a location away from a corner of the panel. Connector 32 can be substantially linear or straight, or slightly curved, e.g., to fit a curvature of a circular or oval shaped panel. For instance, referring in particular to FIGS. 4A and 4B, in some exemplary embodiments, a portion of the outer periphery of the panel (e.g., outer edge 14*a*) is longer than an elongated member (e.g., elongated member 4*a*). As such, at least one end portion of elongated member 4*a* would be disposed away from a corner of the panel and cannot be connected to the panel by connector 31. In the illustrated embodiment, one end portion (e.g., the end portion on the left side in FIG. 4B) of elongated member 4*a* is away from a corner of the panel and connected to the panel by connector 32.

In some exemplary embodiments, at least one connector 32 includes a bottle opener, such as bottle opener 321. In some exemplary embodiments, a magnetic member disposed near the bottle opener to hold the bottle cap after the bottle is opened. The bottle opener and/or magnetic member enhance the functionality of the table and make it more user-friendly.

In some exemplary embodiments, supporting frame 220 includes a first support, such as first support 221*a*, and a second support, such as second support 221*b*. The first support is coupled (directly or indirectly) with the panel assembly at a first panel portion of the panel assembly (e.g., the left side of the panel assembly in FIG. 4A). The second support is coupled (directly or indirectly) with the panel assembly at a second panel portion of the panel assembly (e.g., the right side of the panel assembly in FIG. 4A). For instance, in an exemplary embodiment, the first or second support is coupled with the panel assembly through mounting assembly 12 illustrated in FIG. 5. In some exemplary embodiments, the first and second supports are foldable to the panel assembly, e.g., the first support is rotatable with respect to the first portion of the panel assembly, and the second support is rotatable with respect to the second portion of the panel assembly. In an exemplary embodiment, two panel units 11 are substantially identical and symmetric to each other, and table 200 is foldable to half.

In some exemplary embodiments, each of the first and second supports has a length that is adjustable to allow users to adjust a height of the supporting frame and thus to adjust a height of the table. For instance, in some exemplary embodiments, each of the first and second supports includes a first adjustable leg, such as first adjustable leg 222*a*, and a second adjustable leg, such as second adjustable leg 222*b*. The first and second adjustable legs are spaced apart from each other and substantially parallel to each other. In an exemplary embodiment, each of the first and second adjustable legs includes a first leg member, such as first leg member 24, and a second leg member, such as second leg member 25. The first and second leg members are telescopically coupled with each other.

In some exemplary embodiments, second leg member 25 includes a plurality of slots, such as slot 251, and first leg member 24 includes a fitting member 241 that can be selectively fitted (e.g., snap-fitted) into any one of the slots 251 to allow change of the height. In an exemplary embodiment, markings are provided on second leg member 25 adjacent to the slots to indicate the different heights.

In some exemplary embodiments, each of the first and second supports also includes one or more cross members, such as cross member 26 and cross member 27, connected to the first and second adjustable legs. Additionally, alternatively or optionally, in some exemplary embodiments, cross member 26 includes an adjustment mechanism to selectively allow the first and second adjustable legs to adjust their lengths (e.g., selectively allow the first and second leg members to move with respect to each other), thereby selectively allowing adjustment of the height of the supporting frame. In some exemplary embodiments, supporting frame 220 is substantially the same as or similar to those disclosed in U.S. patent application Ser. No. 17/003,047 (now U.S. Pat. No. 11,241,087 B1), the disclosure of the application is incorporated herein for all purposes by reference in its entirety.

Figure 8:
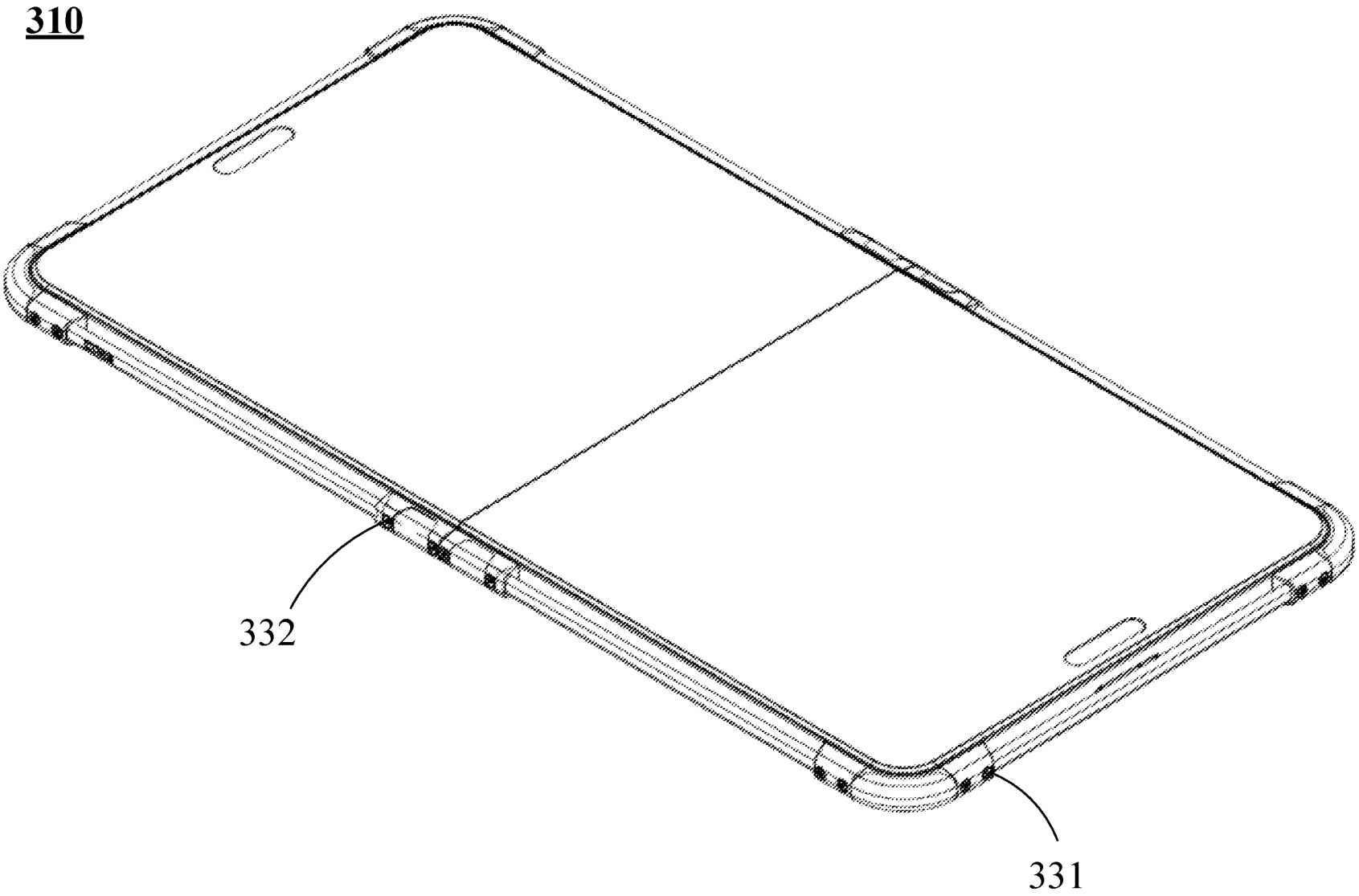
FIG. 8 is a top perspective view illustrating an exemplary panel assembly in accordance with some exemplary embodiments of the present disclosure.

Referring now to FIG. 8, there is depicted exemplary panel assembly 310 in accordance with some exemplary embodiments of the present disclosure. Panel assembly 310 is substantially the same as panel assembly 210, except connector 331 does not include slot 311 and enhancement member 312 and connector 332 does not include bottle opener 321.

The panel assemblies and tables of the present disclosure are advantageous. For instance, the one or more elongated members in the panel assemblies and tables of the present disclosure provide more space and/or options for hanging objects when desired or needed. Also, the one or more elongated members enhance the strength and/or stiffness of the panel and make the panel assembly and table more robust. Further, the bottle opener and/or magnetic member enhance the functionality of the table and make it more user-friendly.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first portion could be termed a second portion, and, similarly, a second portion could be termed a first portion, without changing the meaning of the description, so long as all occurrences of the "first portion" are renamed consistently and all occurrences of the "second portion" are renamed consistently.

What is claimed is:

1. A panel assembly, comprising:

a panel having an outer periphery and an inner body surrounded by the outer periphery;

a plurality of connectors, wherein the plurality of connectors comprises a first connector and a second connector; and one or more elongated members fixedly connected to the panel by the plurality of connectors, wherein the one or more elongated members comprise a first elongated member having a first end portion connected to the panel by the first connector and a second end portion connected to the panel by the second connector, such that the first elongated member is disposed at a side opposite to the inner body of the panel with respect to a first portion of the outer periphery of the panel and spaced apart from the first portion of the outer periphery of the panel, thereby creating a first gap between the first elongated member and the first portion of the outer periphery of the panel that is substantially coplanar with the panel.

2. The panel assembly of claim 1, wherein the panel comprises a first panel unit and a second panel unit.

3. The panel assembly of claim 1, wherein the one or more elongated members are disposed along at least a majority of the outer periphery of the panel.

4. The panel assembly of claim 1, wherein the one or more elongated members comprise a second elongated member disposed adjacent to a second portion of the outer periphery of the panel and spaced apart from the second portion of the outer periphery of the panel, thereby creating a second gap between the second elongated member and the second portion of the outer periphery of the panel.

5. The panel assembly of claim 4, wherein:

the panel comprises a first corner between the first and second portions of the outer periphery; and the first connector is disposed at or adjacent to the first corner, and comprises a first connecting portion to connect the first end portion of the first elongated member to the first portion of the outer periphery of the panel and a second connecting portion to connect an end portion of the second elongated member to the second portion of the outer periphery of the panel.

6. The panel assembly of claim 5, wherein the first connector further comprises a third connecting portion between the first and second connecting portions.

7. The panel assembly of claim 6, wherein a slot is formed in the third connecting portion of the first connector.

8. The panel assembly of claim 6, wherein the panel comprises a second corner, wherein the second connector is substantially the same as the first connector and is disposed at or adjacent to the second corner.

9. A table, comprising:

a supporting frame; and the panel assembly of claim 1, wherein the panel assembly is coupled with the supporting frame and supported by the supporting frame.

10. The table of claim 9, wherein the supporting frame comprises:

a first support movably coupled with the panel assembly at a first panel portion of the panel assembly;

a second support movably coupled with the panel assembly at a second panel portion of the panel assembly, wherein the first and second supports collectively form one or more pairs of scissor lifts to allow change a height of the supporting frame.

11. The table of claim 9, wherein the supporting frame comprises:

a first support coupled with the panel assembly at a first panel portion of the panel assembly; and a second support coupled with the panel assembly at a second panel portion of the panel assembly, wherein each of the first and second supports has a length that is adjustable to allow adjustment of a height of the supporting frame.

12. The table of claim 11, wherein each of the first and second supports comprises:

a first adjustable leg and a second adjustable leg spaced apart from each other and substantially parallel to each other; and an adjustment mechanism disposed between the first and second adjustable legs to selectively allow the first and second adjustable legs to adjust their lengths, thereby selectively allowing adjustment of the height of the supporting frame.

13. The table of claim 11, wherein:

the panel comprises a first corner between the first and second portions of the outer periphery; and the first connector is disposed at or adjacent to the first corner, and includes a first connecting portion to connect the first end portion of the first elongated member to the first portion of the outer periphery of the panel and a second connecting portion to connect an end portion of the second elongated member to the second portion of the outer periphery of the panel.

14. The table of claim 13, wherein the panel comprises a second corner, wherein the second connector is substantially the same as the first connector and is disposed at or adjacent to the second corner.

15. The table of claim 13, wherein:

the first portion of the outer periphery of the panel is longer than the first elongated member; and the second connector is different than the first connector and is substantially linear.

16. The table of claim 11, wherein the panel has four corners and the plurality of connectors has four connectors, each disposed at or adjacent to one of the four corners.

17. The table of claim 11, wherein the panel has four corners and the plurality of connectors has more than four connectors, wherein at least one connector is disposed away from any one of the four corners.

18. A panel assembly, comprising:

a panel having an outer periphery;

a plurality of connectors, wherein the plurality of connectors comprises a first connector and a second connector; and one or more elongated members connected to the panel by the plurality of connectors, wherein the one or more elongated members comprise:

a first elongated member having a first end portion connected to the panel by the first connector and a second end portion connected to the panel by the second connector, such that the first elongated member is disposed adjacent to a first portion of the outer periphery of the panel and spaced apart from the first portion of the outer periphery of the panel, thereby creating a first gap between the first elongated member and the first portion of the outer periphery of the panel; and a second elongated member disposed adjacent to a second portion of the outer periphery of the panel and spaced apart from the second portion of the outer periphery of the panel, thereby creating a second gap between the second elongated member and the second portion of the outer periphery of the panel, wherein:

the panel comprises a first corner between the first and second portions of the outer periphery;

the first connector is disposed at or adjacent to the first corner, and comprises a first connecting portion to connect the first end portion of the first elongated member to the first portion of the outer periphery of the panel, a second connecting portion to connect an end portion of the second elongated member to the second portion of the outer periphery of the panel, and a third connecting portion between the first and second connecting portions; and an outer surface of the third connecting portion comprises one or more creases, grooves, ribs, strips, rims or any combination thereof.

19. A panel assembly, comprising:

a panel having an outer periphery;

a plurality of connectors, wherein the plurality of connectors comprises a first connector and a second connector; and one or more elongated members connected to the panel by the plurality of connectors, wherein the one or more elongated members comprise:

a first elongated member having a first end portion connected to the panel by the first connector and a second end portion connected to the panel by the second connector, such that the first elongated member is disposed adjacent to a first portion of the outer periphery of the panel and spaced apart from the first portion of the outer periphery of the panel, thereby creating a first gap between the first elongated member and the first portion of the outer periphery of the panel; and a second elongated member disposed adjacent to a second portion of the outer periphery of the panel and spaced apart from the second portion of the outer periphery of the panel, thereby creating a second gap between the second elongated member and the second portion of the outer periphery of the panel, wherein:

the panel comprises a first corner between the first and second portions of the outer periphery;

the first connector is disposed at or adjacent to the first corner; and the first portion of the outer periphery of the panel is longer than the first elongated member; and the second connector is different than the first connector, and is substantially linear or straight.

20. The panel assembly of claim 19, wherein the second connector comprises a bottle opener.

* * * * *